United States Patent [19]

Comstedt, deceased et al.

[11] 3,995,576

[45] Dec. 7, 1976

[54] BOAT STEERING ARRANGEMENT PROVIDED WITH AN ANTI-THEFT LOCK

[75] Inventors: Tore Erik Karl Comstedt, deceased, late of Stockholm, Sweden, by Magne Ingvar Martinsson, representative, Frolunda, Sweden

[73] Assignee: Teknoflex Control System AB, Vastra Frolunda, Sweden

[22] Filed: Dec. 10, 1974

[21] Appl. No.: 531,363

[30] Foreign Application Priority Data

Dec. 11, 1973 Sweden ..... 7316702

[52] U.S. Cl. ..... 114/144 R; 70/183; 74/511 R

[51] Int. Cl.[2] ..... B63H 25/08

[58] Field of Search ..... 114/144 R; 74/480 B, 74/511 R; 70/252, 187, 183; 115/35

[56] References Cited

UNITED STATES PATENTS 1,956,438 4/1934 Eichenauer ..... 70/183

3,208,300 9/1965 Morse ..... 114/144 R

*Primary Examiner*—George E. A. Halvosa
*Assistant Examiner*—Gregory W. O'Connor
*Attorney, Agent, or Firm*—Young & Thompson

[57] ABSTRACT

A boat steering with an anti-theft lock, comprising a steering housing having a rotatably journalled steering shaft and a panel attachment intended to be attached to an instrument panel and surrounding the shaft. The steering housing and panel attachment are connected to each other by means of a nut arranged concentric with the shaft. The panel attachment is provided with locking means having a lock bolt which, in the locking position, engages in a notch in the shaft thereby preventing turning of the shaft, the arrangement of the locking cylinder being such that removal of the nut for separation of the steering housing from the panel attachment is prevented.

3 Claims, 2 Drawing Figures

BOAT STEERING ARRANGEMENT PROVIDED WITH AN ANTI-THEFT LOCK

The present invention relates to a boat steering arrangement provided with an anti-theft lock, said arrangement comprising a steering housing having a rotatably journalled cable wheel for engagement with a steering cable and a rotatably journalled shaft which is drivably connected to the cable wheel, one end of said shaft projecting out of the steering housing and being arranged to support a steering wheel, said arrangement also comprising a panel attachment surrounding the shaft, said panel attachment being connected to the steering housing and being intended to be attached to a panel, for example an instrument panel.

The purpose of the invention is to obtain a steering arrangement of the kind disclosed above which is provided with an anti-theft lock, in which arrangement the steering housing can, after the steering arrangement has been mounted into position in the boat, be easily and comfortably removed from the panel attachment for repair or readjustment simultaneously as the anti-theft lock, in its locking position, effectively prevents every attempt to alter the relative positions of the steering housing and the panel attachment from succeeding. In other words, the anti-theft lock shall have the double function of, as is common in for example steering wheel locks in cars, locking the steering shaft to a stationary part, for example the panel attachment, and serving as a lock for the attachment means which connect the steering housing to the panel attachment. Thus, the purpose of the invention is to eliminate such screws as are for example often used for securing steering wheel locks in cars, the heads of which screws being screwed off or broken off after assembly, a practice which makes it considerably more difficult to dismantle the steering wheel lock in connection with for example repair or adjustment.

According to the invention, this is achieved by means of the panel attachment being removably connected to the steering housing with the help of a nut arranged concentric to the shaft, said nut being surrounded by a housing part on the panel attachment and engaging with a threaded portion of a part of the steering housing, said part of the steering housing projecting through a bore in the panel attachment and supporting a locking arrangement having a lock bolt which, in the locking position, projects into the housing part and engages in a notch in the shaft which is situated on that side of the nut which is facing away from the steering housing.

In this construction, the lock cylinder lies in front of the nut — seen from the steering wheel end of the shaft — and, by designing the housing part of the panel attachment in such a way that only a slight distance exists between the side edges of the nut and the inner walls of the housing part, the possibility of reaching the nut with a wrench or some other tool is eliminated as long as the lock cylinder is in its locking position.

Figure 1:
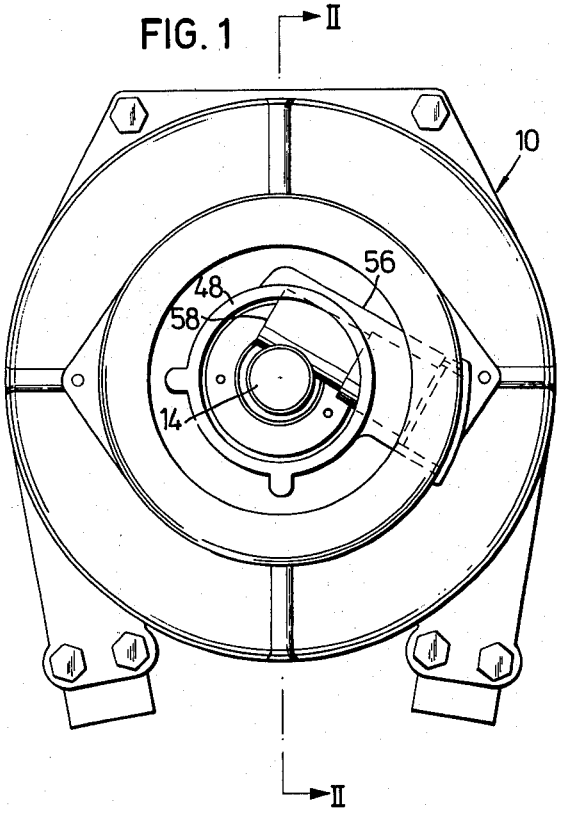
Figure 2:
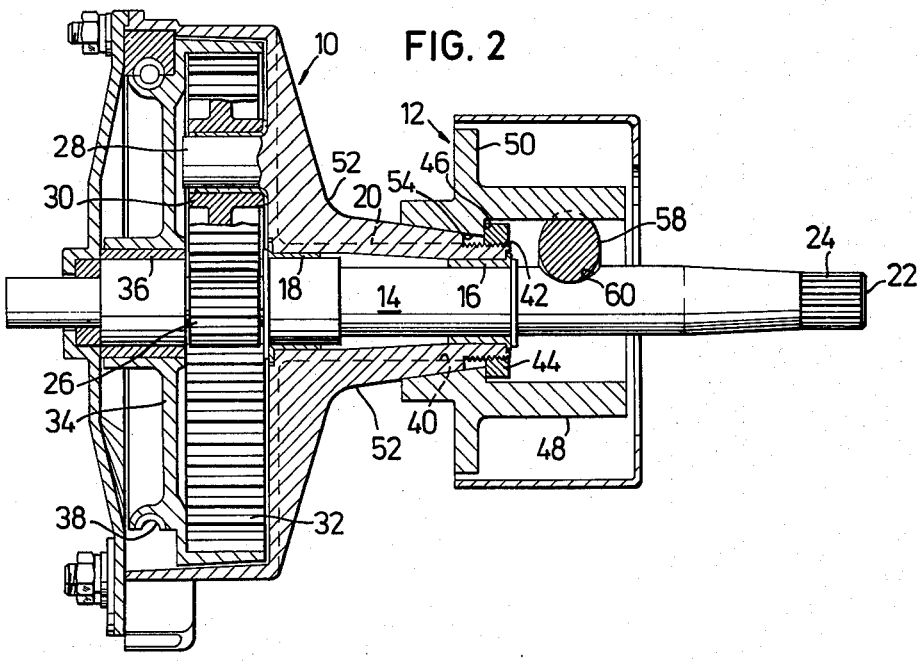

The invention is described in more detail below with reference to an embodiment shown in the accompanying drawing in which FIG. 1 is a frontal view of the steering arrangement according to the invention and FIG. 2 is a section along line 2—2 in FIG. 1.

The steering arrangement consists of a steering housing 10 and a panel attachment 12 through which a shaft 14 extends, said shaft being rotatably journalled in bearings 16 and 18 in a cylindrical elongation 20 of the steering housing 10. One end 22 of the shaft 14 has splines 24 for holding the steering wheel not shown here. The portion of the shaft 14 which is contained in the steering housing has teeth 26 which engage in a gear wheel 30 which is rotatably arranged on a journal 28, said gear wheel in turn engaging in a gear ring 32 provided with inner teeth. The gear ring 32 is designed with a cable wheel 34 as an integral unit, said cable wheel 34 being rotatably journalled on the shaft 14 by means of a bearing 36. The cable wheel 34 has a peripheral groove 38 which is profiled for engagement with a steering cable (not shown) having a spirally threaded casing. By means of turning the shaft 14, the cable wheel 34 is also turned and the steering cable is moved so as to adjust the rudder of the boat.

The steering housing 10 is intended to be held onto a panel, for example the instrument panel of the boat, by means of the panel attachment 12 which is connected to the steering housing 10 on its cylindrical elongation 20 which projects into a bore 40 in the panel attachment 12. The outer end of the elongation 20 has a thread 42 onto which a nut 44 is screwed, said nut abutting a stop 46 on the panel attachment. The nut 44 is surrounded by a housing part 48 arranged on the panel attachment 12 and opening out towards the steering wheel end of the shaft 14, the inner wall of said housing part lying at a small distance from the side edges of the nut 44. An attachment flange 50 projects out sideways from the housing part 48 and is intended to be attached to the instrument panel.

In the shown embodiment, the elongation 20 has four axial flanges 52 which project at 90° angles from each other, said flanges tapering conically towards the thread 42. The bore 40 in the panel attachment 12 has eight axial grooves 54 projecting at 45° angles from each other and having the same form. By means of these flanges and grooves, the steering housing is aligned both axially and peripherally in relation to the panel attachment. At the same time, different adjustments of the steering housing in relation to the panel attachment are allowed so that a comfortable adaption to the actual type of mounting of the arrangement can be made and so that any later alterations of the positioning of the steering housing can be easily carried out by simply loosening the nut 44 with a wrench or some other suitable tool, drawing the elongation 20 of the steering housing 12 out of the bore 40, turning the steering housing for example 45° And reinserting the same into the bore 40.

The housing part 48 of the panel attachment 12, as FIG. 1 shows, is designed having a cylindrical part 56 projecting out from the side, said cylindrical part containing a locking arrangement which, in itself, is previously known, not shown here, and which has a rotatable bolt 58 which can be inserted into the housing part. In the locking position, the bolt 58 engages, as FIG. 2 shows, in a groove 60 which has been recessed in the shaft 14, thereby locking the shaft 14 against turning relative the panel attachment 12. As the panel attachment is stationarily connected to the steering housing 10 in the above-described manner, the shaft is also locked against turning relative the steering housing. By means of the bolt 58 lying in front of the nut 44, as seen from the steering wheel end of the shaft 14, the possibility of reaching the nut 44 is eliminated.

What is claimed is:

1. Boat steering arrangement provided with an anti-theft lock, comprising a steering housing having a rotatably journalled cable wheel for engagement with a steering cable and a rotatably journalled shaft which is drivably connected to the cable wheel, one end of said shaft projecting out of the steering housing and being arranged to support a steering wheel, said steering arrangement also comprising a panel attachment surrounding the shaft, said panel attachment being connected to the steering housing and intended to be attached to a panel, characterized in that the panel attachment is removably connected to the steering housing by means of a nut which is arranged concentric to the shaft, said nut being surrounded by a housing part on the panel attachment and engaging in a threaded portion of a part of the steering housing, said part projecting through a bore in the panel attachment, said housing part supporting a locking arrangement having a lock bolt which, in the locking position, projects into the housing part and engages in a notch in the shaft which is situated on that side of the nut which is facing away from the steering housing.

2. Steering arrangement according to claim 1, characterized in that the lock bolt, in the locking position, engages at a right angle to the shaft in a notch recessed in the shaft, and notch having an essentially circular segment cross-section.

3. Steering arrangement according to claim 1, characterized in that the part of the steering housing which projects into the bore in the panel attachment has, adjacent the threaded section, axial flanges tapering conically towards the threaded section, said flanges engaging in grooves in the bore, said grooves having a corresponding form.

* * * * *